US009341331B2

(12) United States Patent
Wang

(10) Patent No.: US 9,341,331 B2
(45) Date of Patent: May 17, 2016

(54) TWINKLING DOOR HANGER

(71) Applicant: Hua-Cheng Pan, Tainan (TW)

(72) Inventor: Chih-Liang Wang, Tainan (TW)

(73) Assignee: Hua-Cheng Pan, Tainan (TW)

( * ) Notice: Subject to any disclaimer, the term of this patent is extended or adjusted under 35 U.S.C. 154(b) by 102 days.

(21) Appl. No.: 14/462,579

(22) Filed: Aug. 19, 2014

(65) Prior Publication Data

US 2016/0053953 A1 Feb. 25, 2016

(51) Int. Cl.

| | |
|---|---|
| ***F21V 7/04*** | (2006.01) |
| ***F21S 10/00*** | (2006.01) |
| ***F21V 33/00*** | (2006.01) |
| ***F21V 23/00*** | (2015.01) |
| ***F21V 23/04*** | (2006.01) |
| ***F21S 9/02*** | (2006.01) |
| *F21W 121/00* | (2006.01) |
| *F21Y 101/02* | (2006.01) |

(52) U.S. Cl.

CPC ..... *F21S 10/005* (2013.01); *F21S 9/02* (2013.01); *F21V 23/003* (2013.01); *F21V 23/0471* (2013.01); *F21V 33/0028* (2013.01); *F21W 2121/00* (2013.01); *F21Y 2101/02* (2013.01)

(58) Field of Classification Search

CPC ..... F21S 9/02; F21S 10/005; F21V 23/003; F21V 23/0471; F21V 33/0024; F21V 33/0028

USPC ..... 362/458, 602–605

See application file for complete search history.

(56) References Cited

U.S. PATENT DOCUMENTS

2014/0268866 A1* 9/2014 Yang ..... G09F 19/00 362/605

* cited by examiner

*Primary Examiner* — Jason Moon Han

(74) *Attorney, Agent, or Firm* — Leong C. Lei

(57) ABSTRACT

A twinkling door hanger mainly includes: a main body, being 3D body modeling, a front side thereof having a pair of slots opposite to each other, a wall of each slot being configured with a light transmissive hole; at least two light guiding plates, stacked together and inserted in the slots in a separable way, each thereof having a light incidence face corresponding to the light transmissive hole, and a plate face of each light guiding plate perpendicular to the light incidence face having a decorative pattern, and the decorative pattern of each light guiding plate being staggered; and a circuit unit, fixed to one side of the main body, having a control circuit in connection with a battery and providing electricity, at least having two light-emitting elements and a control circuit adapted to control each light-emitting element to wink in sequence, each light-emitting element illuminating toward the corresponding light incidence face. Whereby, allowing the present invention to achieve an effect of the staggered twinkle of the decorative patterns.

7 Claims, 7 Drawing Sheets

TWINKLING DOOR HANGER

TECHNICAL FIELD OF THE INVENTION

The present invention relates to a door hanger, and more particularly to a structure having a twinkling effect.

DESCRIPTION OF PRIOR ART

Accompanying the change of life style and the improvement of economic environment, people have a variety of demands for the decoration of their life space. People diversify their living space by hanging various models of hanging decorations. To change surrounding atmosphere and convert mood, a variety of small decorative objects have appeared in the consumer market.

The main bodies of conventional door hangers includes a variety of modeling designs, the front sides of some of them even have welcome or inspirational words. However, no matter what kinds of words are put on, most of conventional door hangers are lack of variability.

Moreover, additional illumination are needed to apply on most conventional door hanging decorations in a dim environment, and the main bodies thereof have no twinkling function, being rather not eye-catching.

SUMMARY OF THE INVENTION

The main object of the present invention is to provide a newly designed door hanger, having a twinkling effect to make it more eye-catching.

To achieve the object mentioned above, the present invention proposes a twinkling door hanger, mainly including:

a main body, being 3D body modeling, a front side thereof having a pair of slots opposite to each other, and a wall of each slot being configured with a light transmissive hole;

at least two light guiding plates, stacked together and inserted in the slots in a separable way, a light incident face corresponding to the through hole being formed on at least one side of each light guiding plate, a plate face of each light guiding plate perpendicular to each light incident face having a decorative pattern and the decorative pattern of each light guiding plate being staggered, and a circuit unit, having a control circuit in electric connection with a battery to provide electricity, at least two light-emitting elements being respectively fixed to each light transmissive hole and illuminating toward the corresponding light incidence face, the control circuit being configured on a rear side of the main body, each light-emitting element being in electric connection with the control circuit thereby to be driven to wink in a time sequence preset in the control circuit.

Whereby, when the light-emitting elements are switched on, the light beams can be scattered into the light guiding plates through the light incidence faces, and the two light-emitting elements wink in sequence, allowing the decorative pattern of each light guiding plate to be more eye-catching, and forming an effect of the staggered twinkling of the decorative patterns.

DETAILED DESCRIPTION OF THE PREFERRED EMBODIMENTS

Figure 1:
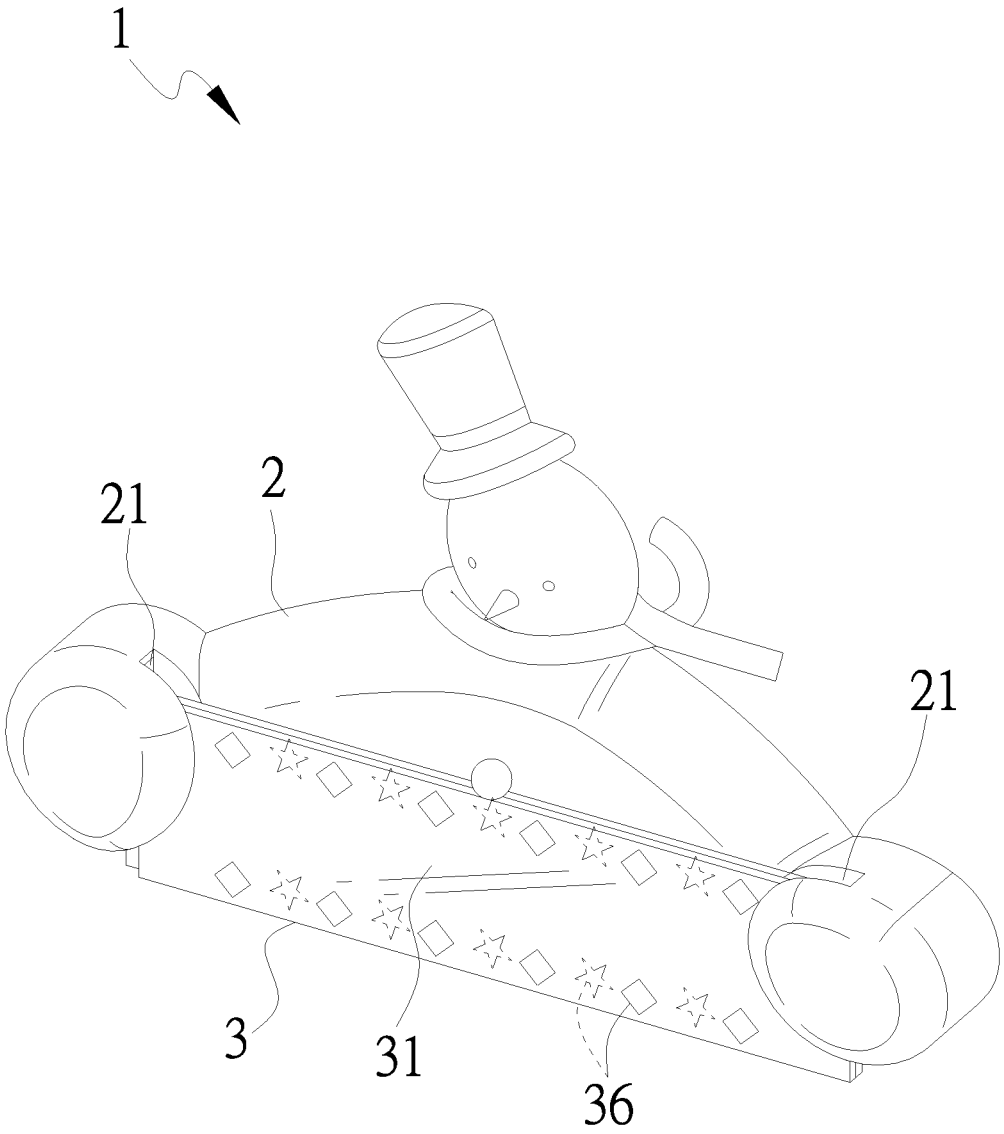
FIG. 1 is a schematically perspective view of the present invention.
Figure 2:
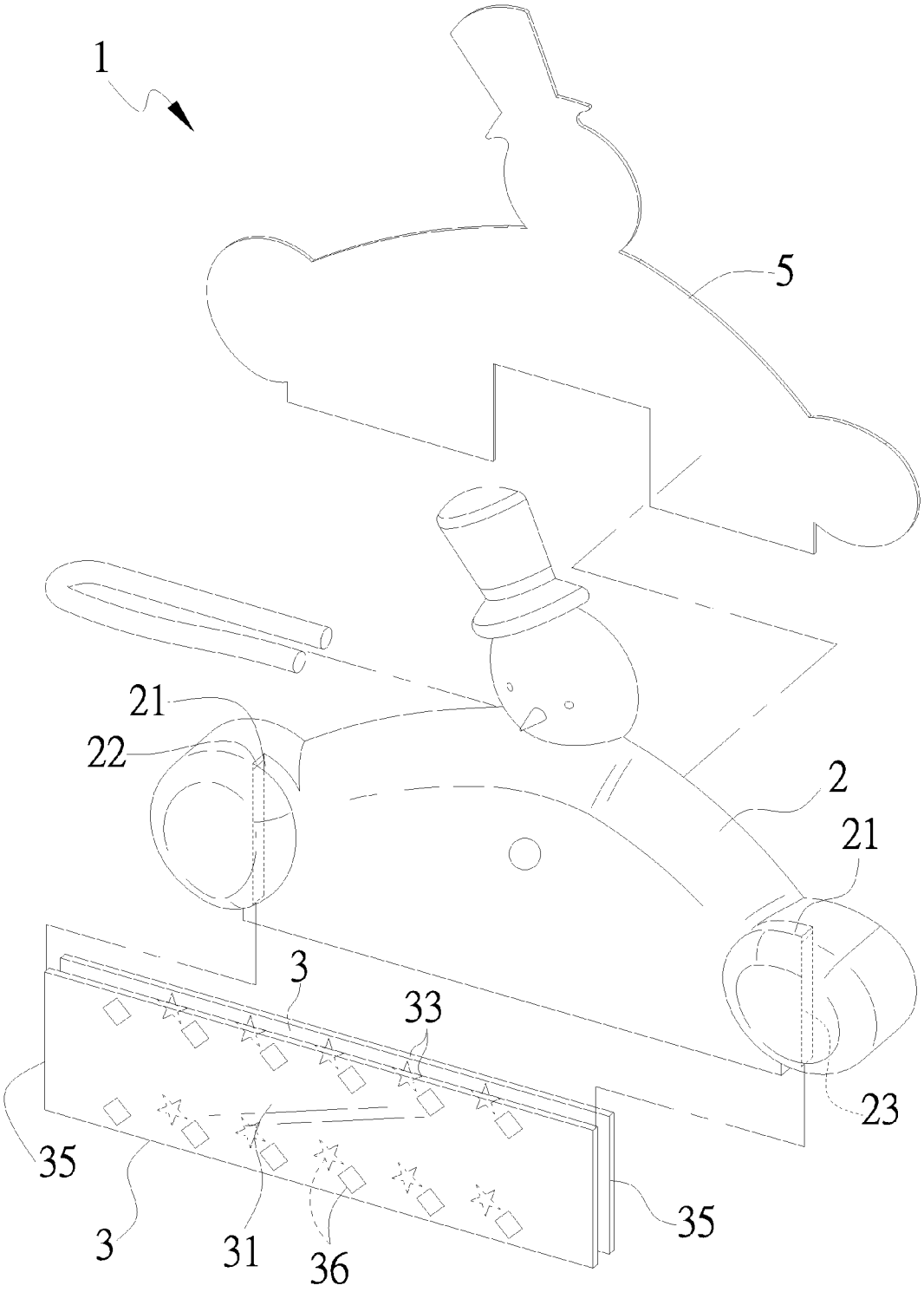
FIGS. 2 and 3 respectively are an exploded view of the present invention.
Figure 3:
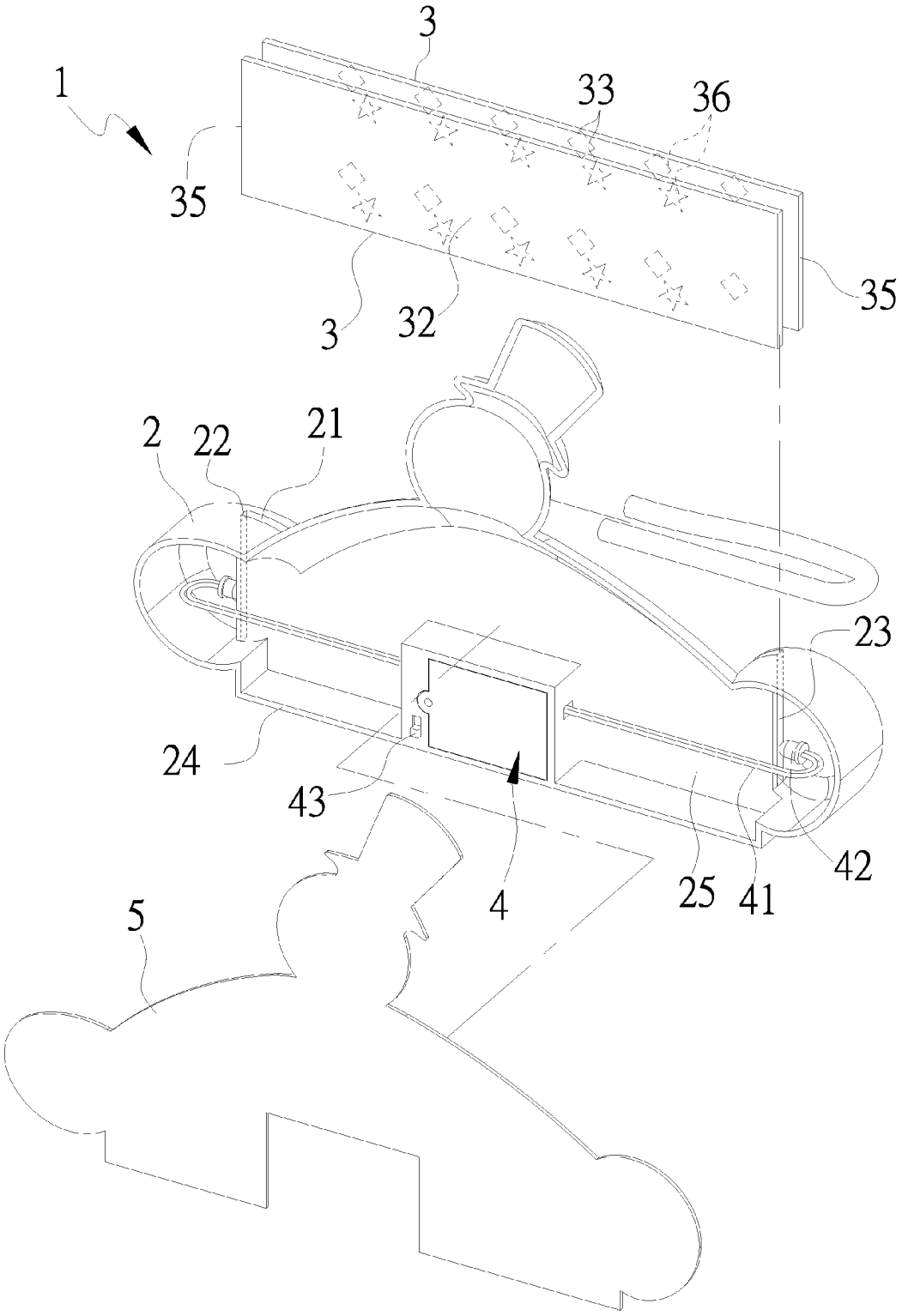
Figure 4:
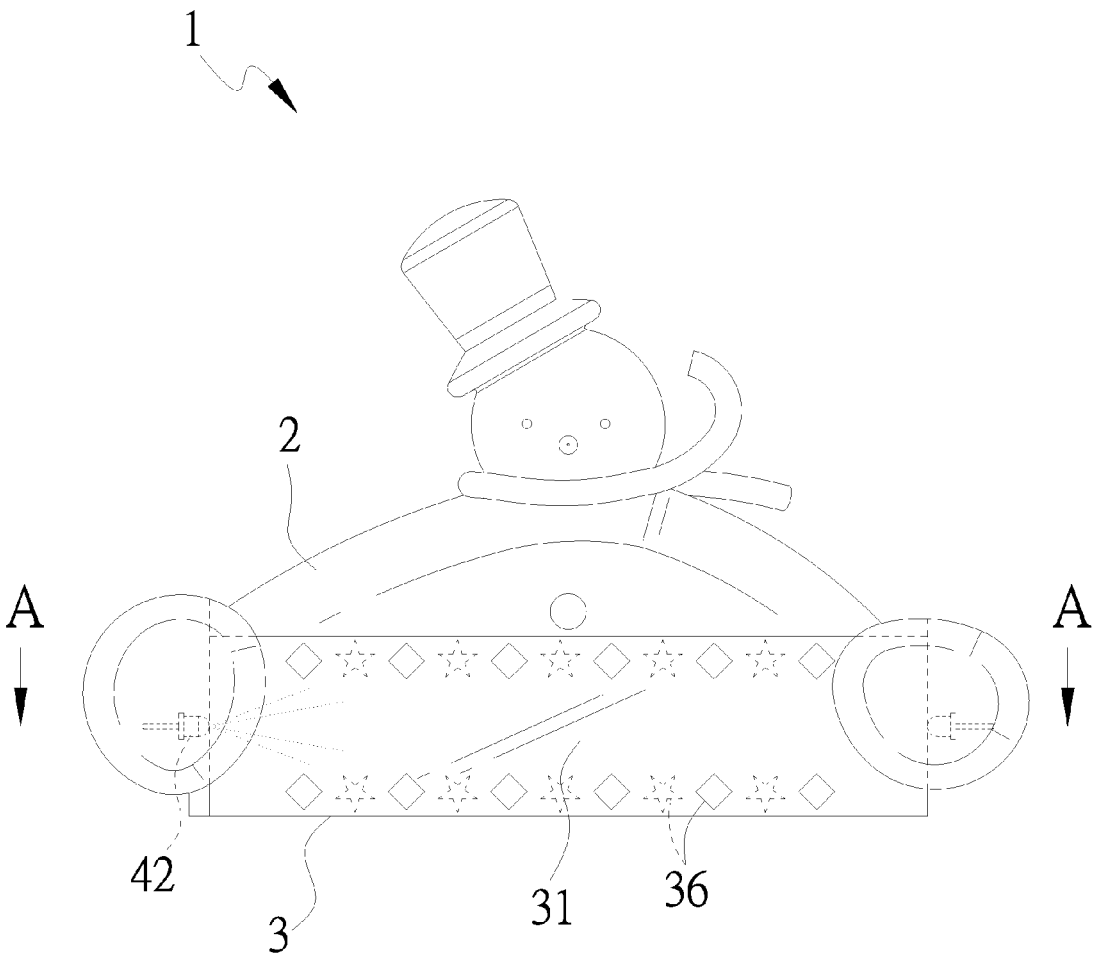
FIG. 4 is a front view of the present invention.
Figure 5:
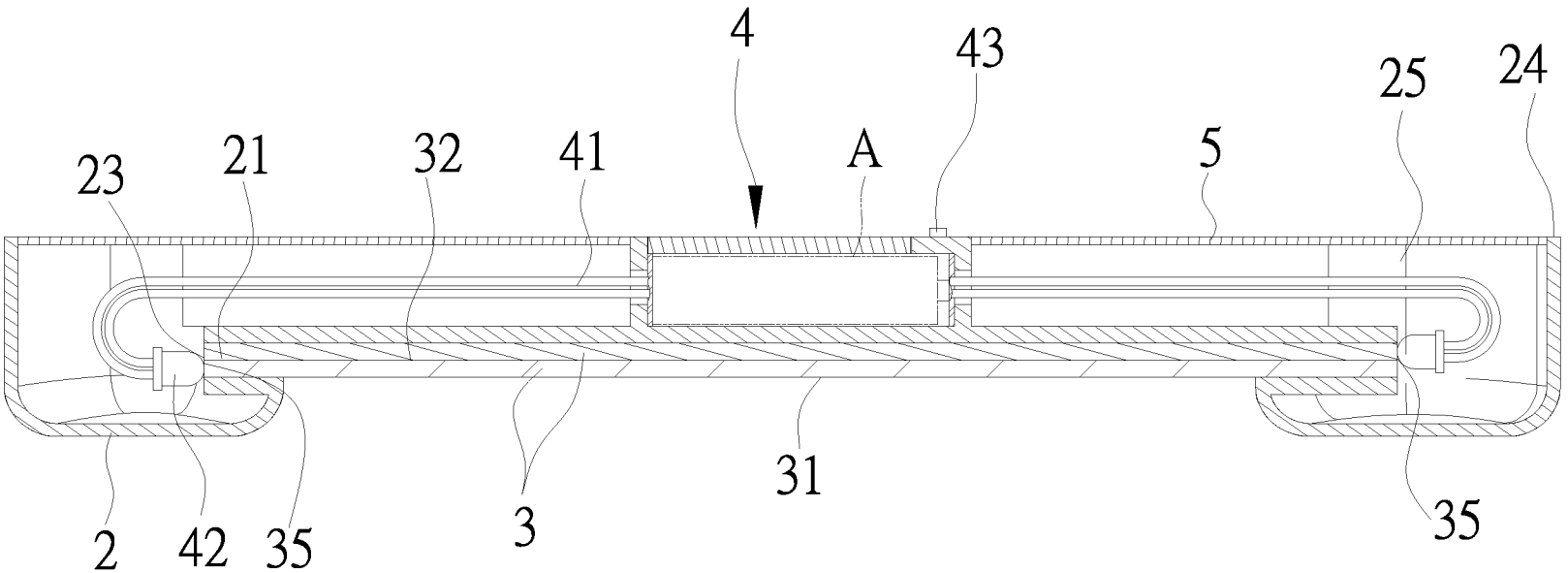
FIG. 5 is a cross-sectional view taken along line A-A of FIG. 4.
Figure 6:
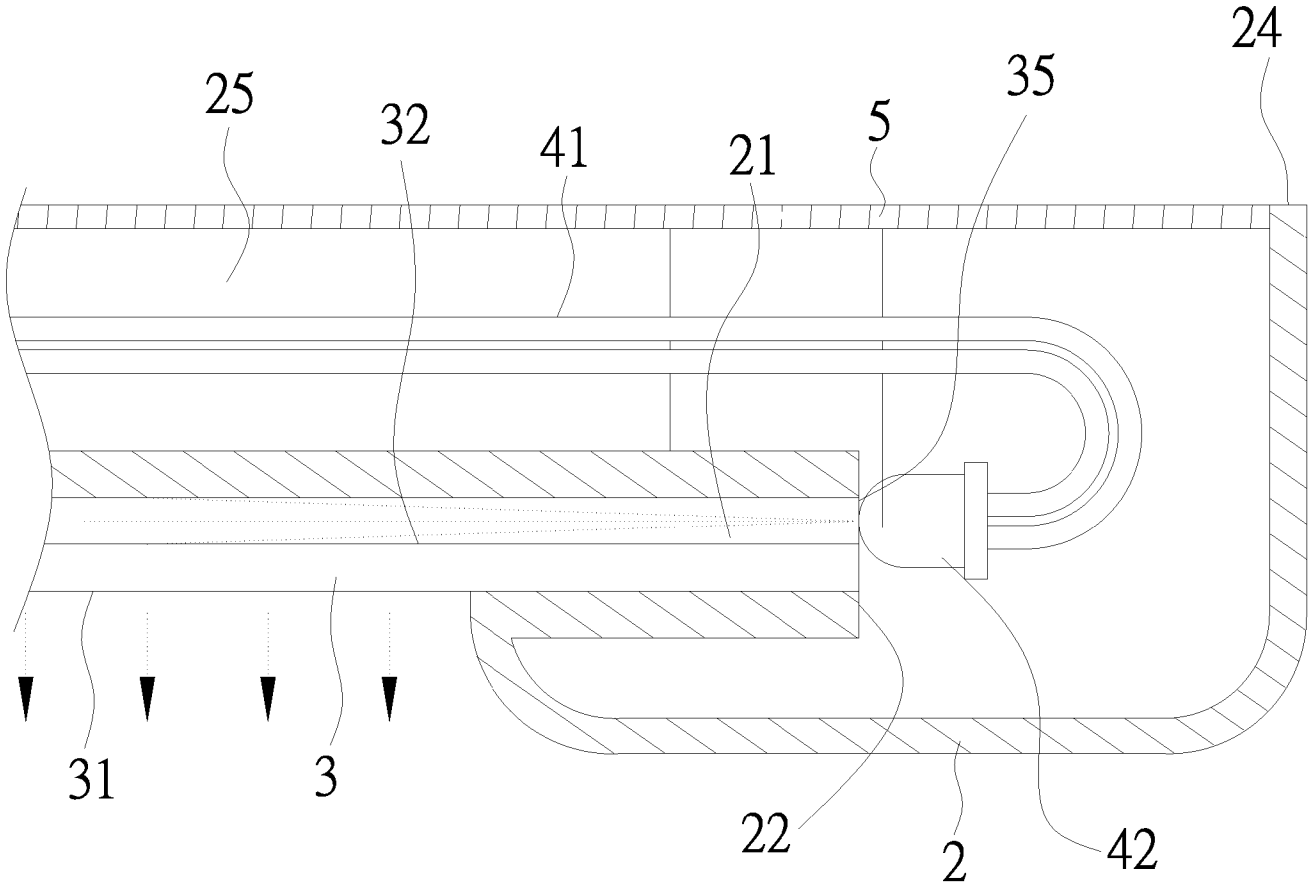
FIG. 6 is a partly enlarged view of FIG. 5.
Figure 7:
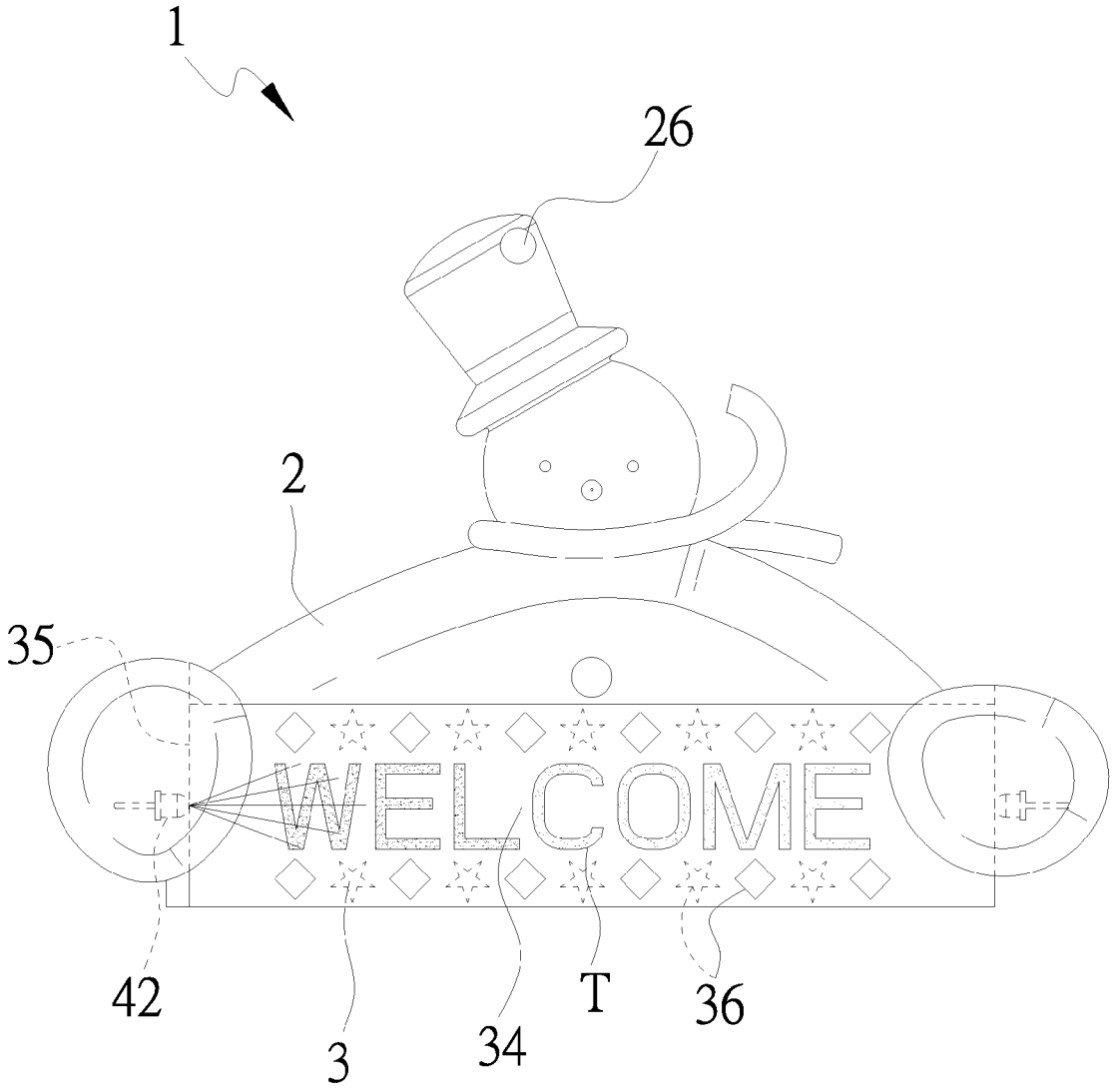
FIG. 7 is a schematic view of a preferred embodiment according to the present invention.

Referring to FIGS. 1 to 3, which respectively are a schematically perspective view, exploded view seeing from one vision angle and exploded view seeing from another vision angle of the present invention, one preferred embodiment of a twinkling door hanger according to the present invention is shown. A twinkling door hanger 1 according to the present invention is used for a decoration in an environmental space in a matching way, and specially used on a door plate so as to obtain a decoration profiting effect for the door plate. The door hanger 1 includes a main body 2, at least two light guiding plates 3 and a circuit unit 4, where the main body 2 is 3D body modeling, the front side thereof has a pair of "⊏"-shaped slots 21 opposite to each other, where the bottom wall 22 of each slot 21 is configured with a light transmissive hole 23, and the rear side of the main body 2 is a planar surface 24. Furthermore, a bare area 25 is formed fr cm m the planar surface 24 toward the front side of the main body 2, allowing the entire main body 2 to be formed into a thin shell. In the present embodiment, the main body 2, for example, is a snowman bust having two hands, but the present invention is not so limited. It is noticed here that the light transmissive hole 23 may only be configured on only one slot 21; in the present embodiment, one light transmissive hole 23 is configured on each slot 21. Particularly, in the present embodiment, the slot 21 is configured on each hand portion of the snowman bust.

The light guiding plates 3 are stacked together and configured in the slots 21 in a separable way. Furthermore, each light guiding plate 3 is a plastic plate pervious to light, having a front side wall 31 and rear side wall 32 separated apart and a peripheral wall between the front side wall 31 and rear side wall in connection therewith. A decorative pattern 36 is carved on the front side wall 31 and has a very good light convergence effect because grooves are formed on the decorative pattern of the front side wall 31 of the light guiding plate 3. In addition, the decorative pattern 36 on each light guiding plate 3 may be staggered or arranged with different shapes. Moreover, a light incidence face 35 corresponding to the light transmissive hole 23 is formed on the peripheral wall 33.

The control unit 4 is a case body, having a control circuit 41 adapted to be in connection with a battery A to provide electricity, and at least two light-emitting elements 42 respectively corresponding to the light transmissive hole 23 and illuminate toward the light incidence face 35. The circuit unit 4 is configured on the bare area 25 of the rear side of the main body 2. In the present embodiment, the circuit unit 4 is integrated with the case body of the main body 2, one side of which is aligned with the planar surface 24 on the rear side of the main body 2. Each light-emitting element 42 is an LED, in electric connection with the control circuit 41. In the present embodiment, one light-emitting element 42 is configured for each light transmissive hole 23, but the present invention is not so limited, more than one light-emitting element 42 may be also designed for each light transmissive hole 23.

Furthermore, the circuit unit 4 may further includes a switch 43 in electric connection with the control circuit 41, the switch 43 may be a general manual switch or shaking switch.

The present invention further includes a back plate 5 configured on the rear side of the main body 2, mainly adapted to seal the bare area 25, allowing the light beams emitted from each light-emitting element 42 to be more centralized, and the control circuit 41, therefore, is not exposed to the outside of the main body 2, thereby assuring use safety relatively.

Next, referring to FIGS. 4 to 7, which respectively are a front view, cross-sectional view, partly enlarged view and schematic view of the implementation of the present invention, the planar surface 24 of the rear side of the main body 2 is assembled on a door plate (not show in the figures), allowing the front side wall 31 of the light guiding plate 3 to face the outside upon use. Additionally, to enable the present invention to be hung on a door knob (not shown in the figures), a hanging hole 26, through which the door knob is passed, is configured on the main body 2. Whereby, the present invention can be not only assembled on a door plate, but hung on a door knob upon use.

The decoration patterns 36 twinkle with the light beams emitted from the corresponding light-emitting elements 42 to have a decoration profiting effect of staggered twinkling when the switch 43 is switched on. In addition, if the switch 43 is a shaking switch, the power source is then conducted to drive the light-emitting element 42 only if a door plate is moved slightly.

Furthermore, a place on each light-guiding plate 3 is surrounded by the decorative pattern 36 to form a writing area 34 on which a fluorescent marker or a fluorescent marker suitable for use on LED writing boards which has a better effect may be used to write words T or paint patterns. When the present invention is switched on, the light beams emitted from each light-emitting element 42 will be incident on the light incidence face at one side of each light-guiding plate 3 and distributed in the entire light guiding plate 3 uniformly, allowing the words T or patterns written or painted on the writing area 34 to be more eye-catching through the illumination of the light beams.

To sum up, the present invention has the following advantages:

1. the light guiding plate has a decoration profiting effect of the staggered twinkling of the decorative pattern.
2. the light guiding plate configured with the writing area is convenient to be taken out any time for the erasion and alteration of words or patterns thereon any time.
3. the words or patterns can be more eye-catching due to the illumination of the light-emitting element in a dim environment.

I claim:

1. A twinkling door hanger, comprising:

a main body for hanging on a door, being 3D body modeling, a front side thereof having a pair of slots opposite to each other, a wall of each said slot being configured with a light transmissive hole;

at least two light guiding plates, stacked together and inserted in said slots of said main body in a separable way, a light incidence face being formed on at least one side of said light guiding plate corresponding to said light transmissive hole, a plate face of each said light guiding plate perpendicular to said light incidence face having a decorative pattern, and said decorative pattern of each said light guiding plate being staggered; and a circuit unit, having a control circuit in connection with a battery and providing electricity, at least two light-emitting elements being fixed to said respective light transmissive hole, and illuminating toward said corresponding light incidence face, said control circuit being configured on a rear side of said main body, each said light-emitting element being in electric connection with said control circuit and driven to wink depending on a time sequence preset by said control circuit.

2. The twinkling door hanger according to claim 1, wherein a rear side of said main body is a planar surface, and formed with a bare area from said planar surface toward a front side of said main body.

3. The twinkling door hanger according to claim 2, further comprising a back plate configured on said rear side of said main body, and adapted to seal said bare area.

4. The twinkling door hanger according to claim 1, wherein a hanging hole is configured on said main body.

5. The twinkling door hanger according to claim 1, wherein a writing area is surrounded by said decorative pattern of each said light guiding plate.

6. The twinkling door hanger according to claim 1, wherein said circuit unit further comprises a switch in electric connection with said control circuit.

7. The twinkling door hanger according to claim 6, wherein said switch is a shaking switch.

* * * * *